US008135329B2

(12) United States Patent
Shimizu et al.

(10) Patent No.: US 8,135,329 B2
(45) Date of Patent: Mar. 13, 2012

(54) TONER CONVEYER DEVICE, PROCESS CARTRIDGE, AND IMAGE FORMING APPARATUS

(75) Inventors: Yoshiyuki Shimizu, Osaka (JP); Tomofumi Yoshida, Ibaraki (JP); Hirobumi Ooyoshi, Ibaraki (JP); Koji Kato, Ibaraki (JP); Kenzo Tatsumi, Osaka (JP); Yoshihiro Kawakami, Hyogo (JP); Tomohiro Kubota, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 1078 days.

(21) Appl. No.: 11/872,228

(22) Filed: Oct. 15, 2007

(65) Prior Publication Data

US 2008/0095559 A1 Apr. 24, 2008

(30) Foreign Application Priority Data

Oct. 18, 2006 (JP) ..... 2006-283258
Aug. 28, 2007 (JP) ..... 2007-220649

(51) Int. Cl.
*G03G 21/00* (2006.01)

(52) U.S. Cl. ... 399/358; 399/359; 399/360; 430/119.86; 430/119.87; 430/119.88

(58) Field of Classification Search ..... 399/358, 399/120, 359–360; 430/119.86–119.88
See application file for complete search history.

(56) References Cited

U.S. PATENT DOCUMENTS 5,065,195 A * 11/1991 Haneda et al. ..... 399/112
5,857,405 A * 1/1999 Bischof ..... 100/37
5,887,224 A * 3/1999 Mizuishi et al. ..... 399/62
6,014,541 A * 1/2000 Kato et al. ..... 399/358
6,055,405 A * 4/2000 Knott et al. ..... 399/358
6,085,062 A * 7/2000 Mizuishi et al. ..... 399/358
6,339,689 B1 * 1/2002 Sugiura ..... 399/120
RE38,978 E * 2/2006 Nakajima et al. ..... 399/359
7,103,308 B2 * 9/2006 Wakana ..... 399/358
7,424,263 B2 * 9/2008 Shimizu et al. ..... 399/358
7,426,365 B2 * 9/2008 Uchihashi ..... 399/358
7,639,957 B2 * 12/2009 Kato et al. ..... 399/30
7,693,477 B2 * 4/2010 Chatani et al. ..... 399/358
7,720,428 B2 * 5/2010 Hagi et al. ..... 399/360
7,890,044 B2 * 2/2011 Shimizu et al. ..... 399/350
7,917,076 B2 * 3/2011 Inoue ..... 399/358
7,945,203 B2 * 5/2011 Shimizu et al. ..... 399/358
7,962,063 B2 * 6/2011 d'Entrecasteaux ..... 399/120

(Continued)

FOREIGN PATENT DOCUMENTS

JP 05224562 A * 9/1993

(Continued)

OTHER PUBLICATIONS

English machine translation of Iwasaki (JP pub 2005-037481).*

(Continued)

*Primary Examiner* — David Gray
*Assistant Examiner* — Geoffrey Evans
(74) *Attorney, Agent, or Firm* — Oblon, Spivak, McClelland, Maier & Neustadt, L.L.P.

(57) ABSTRACT

A toner conveyer device for use din an image forming apparatus includes a toner conveyer belt conveys waste toner, a screw member that receives the waste toner from the toner conveyer belt and conveys the waste toner to a housing unit, and a scraping member that scrapes waste toner that adheres to the screw member.

16 Claims, 9 Drawing Sheets

U.S. PATENT DOCUMENTS

| | | | | |
|---|---|---|---|---|
| 7,995,949 | B2 * | 8/2011 | Shimizu | 399/102 |
| 8,019,254 | B2 * | 9/2011 | Tatsumi et al. | 399/120 |
| 2002/0025202 | A1 * | 2/2002 | Itaya et al. | 399/350 |
| 2005/0019066 | A1 * | 1/2005 | Ito et al. | 399/302 |
| 2006/0005523 | A1 * | 1/2006 | Weiand | 56/364 |
| 2008/0089727 | A1 * | 4/2008 | Shimizu et al. | 399/360 |
| 2008/0267661 | A1 * | 10/2008 | Yoshida et al. | 399/120 |
| 2011/0158723 | A1 * | 6/2011 | Yokokawa | 399/358 |

FOREIGN PATENT DOCUMENTS

| | | | |
|---|---|---|---|
| JP | 6-26932 | | 7/1994 |
| JP | 9-185205 | | 7/1997 |
| JP | 11-327397 | | 11/1999 |
| JP | 2001-42733 | | 2/2001 |
| JP | 2002-241569 | | 8/2002 |
| JP | 2005037481 | A * | 2/2005 |
| JP | 2005-292300 | | 10/2005 |
| JP | 3768810 | | 2/2006 |

OTHER PUBLICATIONS

English machine translation of Nagakura (JP pub 05-224562).*
U.S. Appl. No. 12/257,547, filed Oct. 24, 2008, Kubota, et al.
U.S. Appl. No. 11/870,136, filed Oct. 10, 2007, Tatsumi, et al.
U.S. Appl. No. 12/170,842, filed Jul. 10, 2008, Kubota, et al.

* cited by examiner

TONER CONVEYER DEVICE, PROCESS CARTRIDGE, AND IMAGE FORMING APPARATUS

CROSS-REFERENCE TO RELATED APPLICATIONS

The present application claims priority to and incorporates by reference the entire contents of Japanese priority documents 2006-283258 filed in Japan on Oct. 18, 2006 and 2007-220649 filed in Japan on Aug. 28, 2007.

BACKGROUND OF THE INVENTION

1. Field of the Invention

The present invention relates to a toner conveyer device that conveys waste toner.

2. Description of the Related Art

In conventional image forming apparatuses such as copiers, facsimile machines, and printers, a service staff generally carries out replacement of consumable or life-limited components and maintenance of them. However, the trend is changing and the user is carrying out exchange of supplies and maintenance. In addition, smaller components are used for suppressing the size and the cost of the image forming apparatus. Therefore, the user needs to periodically exchange parts that deteriorate in quality earlier than the life of the apparatus or a waste-toner container. The waste-toner container contains residual materials such as toner, which is a developer, or fiber from transfer sheets. Moreover, because the image forming apparatus is installed adjacent to a user of a personal computer in the times of widespread use of personal computers reduction of noise during operation of the image forming apparatus is another problem that needs attention.

Toner that fails to be transferred onto the transfer sheet is removed and conveyed into a waste-toner container. To recycle the waste toner, an additional path and an additional driving unit for collecting the waste toner becomes necessary. As a result, the image forming apparatus becomes larger. The waste toner contains foreign materials such as fiber from the transfer sheets. Removal of the fiber makes control process or reuse process complicated. If a full-color image forming apparatus that uses three or four toners performs the waste-toner recycling process, considerably larger waste-toner container is required so that structure of the full-color image forming apparatus becomes much complicated. For this reason, in some of the image forming apparatuses, the waste toner is just conveyed into the waste-toner container and the waste-toner container is replaced with another one when the waste-toner container is full with the waste toner.

It is possible to provide a waste-toner container that can contain all the waste toner generated during a whole life of the apparatus. However, such a waste-toner container is considerably large. Therefore, there is a need for filling the waste toner into the waste-toner container in an effective manner to decrease the frequency of replacing the waste-toner container. The waste toner is poured into the waste-toner container from the top, and a sensor is installed on the top part of the waste-toner container. The sensor is a detecting unit for detecting whether the waste-toner container is filled to its capacity and for notifying time of exchange. Exchange cycle of the waste-toner container is prolonged if the waste-toner container is filled with the waste toner without an unfilled space, that is, the waste toner does not accumulate in one particular part of the waste-toner container.

In the conventional image forming apparatus two methods are used to properly fill up the waste-toner container. One method is to periodically shake the waste-toner container and the other method is to locate an agitating screw on the top part of the waste-toner container to flatten a pile of the waste toner inside the waste-toner container.

Japanese Patent Application Laid-open No. H11-327397 discloses an image forming apparatus that includes an photoconductor, a cleaning device that cleans a toner-image formation surface of the photoconductor, a cleaner case (waste-toner conveyer path) that conveys the waste toners removed by the cleaning device, and a toner conveyer screw (screw member) that conveys the waste toners. The image forming apparatus further includes a hammer member (impact-pressure making unit) that gives an impact to the cleaner case or the toner conveyer screw. The hammer member gives an impact when the image formation process is not performed by the photoconductor. More particularly, in the cleaner case there is an elastic projection arranged in contact with a thread of the toner conveyer screw. When the toner conveyer screw is rotated, the projection is brought into contact with the thread in an electrical manner to give vibration to the toner conveyer screw. Then, the toner adhered to the toner conveyer screw falls due to the vibration, thus preventing decrease of a conveyable waste-toner amount.

Japanese Patent Application Laid-open No. 2002-241569 discloses a residual-toner recovery device for use in an image forming apparatus that includes a residual-toner dropping path through which the residual toners fall down and a conveyer path that connects between the residual-toner dropping path and the residual-toner recovery container. The toner adhered to a peripheral surface of a toner-image forming unit are removed from the toner-image forming unit by a cleaning mechanism and fall down through the residual-toner dropping path. A residual-toner conveyer mechanism includes a sweep roller having an elliptical cross section, positioned near the connection with the conveyer path in the residual-toner dropping path, and a scraper made of a flexible member, having the distal end pressed against the peripheral surface of the sweep roller in the return side of the rotation direction, with the proximal end of the scraper fitted to the inner wall of the residual-toner dropping path. The scraper is formed with a recess at parts other than the part which is in contact with the sweep roller. With this arrangement, the increase of the internal pressure of the residual-toner dropping path on which the return side of the sweep roller in the rotation direction is positioned can be suppressed, while maintaining the toner-scrape performance of scraping the toners adhered to the sweep roller positioned in the residual-toner dropping path.

However, in the conventional image forming apparatus, collected waste toner accumulates unevenly in the waste-toner container, and space in the waste-toner container is not effectively filled.

Moreover, electrophotographic devices have become smaller so that a range of users has become broader. However, a shorter conveyance path makes it difficult to maintain efficiency in conveying waste toner. There is a need for improving the efficiency.

SUMMARY OF THE INVENTION

It is an object of the present invention to at least partially solve the problems in the conventional technology.

According to an aspect of the present invention, there is provided a toner conveyer device for use in an image forming apparatus. The toner conveyer device includes a toner conveyer belt that conveys waste toner; a screw member that receives the waste toner from the toner conveyer belt and conveys the waste toner to a housing unit; and a scraping member that scrapes waste toner that adheres to the screw member.

According to another aspect of the present invention, there is provided a process cartridge that is detachable from an image forming apparatus. The process cartridge includes a photoconductor that carries a latent image; a cleaning device that removes waste toner remaining on the photoconductor; and the toner conveyer device described above.

According to still another aspect of the present invention, there is provided an image forming apparatus that includes a photoconductor that carries an electrostatic latent image; a developing device that receives toner from a developing-agent carrier and develops the latent image with the toner to form a toner image; a transfer device that transfers the toner image onto a recording medium; a cleaning device that removes residual waste toner from the photoconductor; and the above toner conveyer device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained below with reference to the accompanying drawings.

Figure 1:
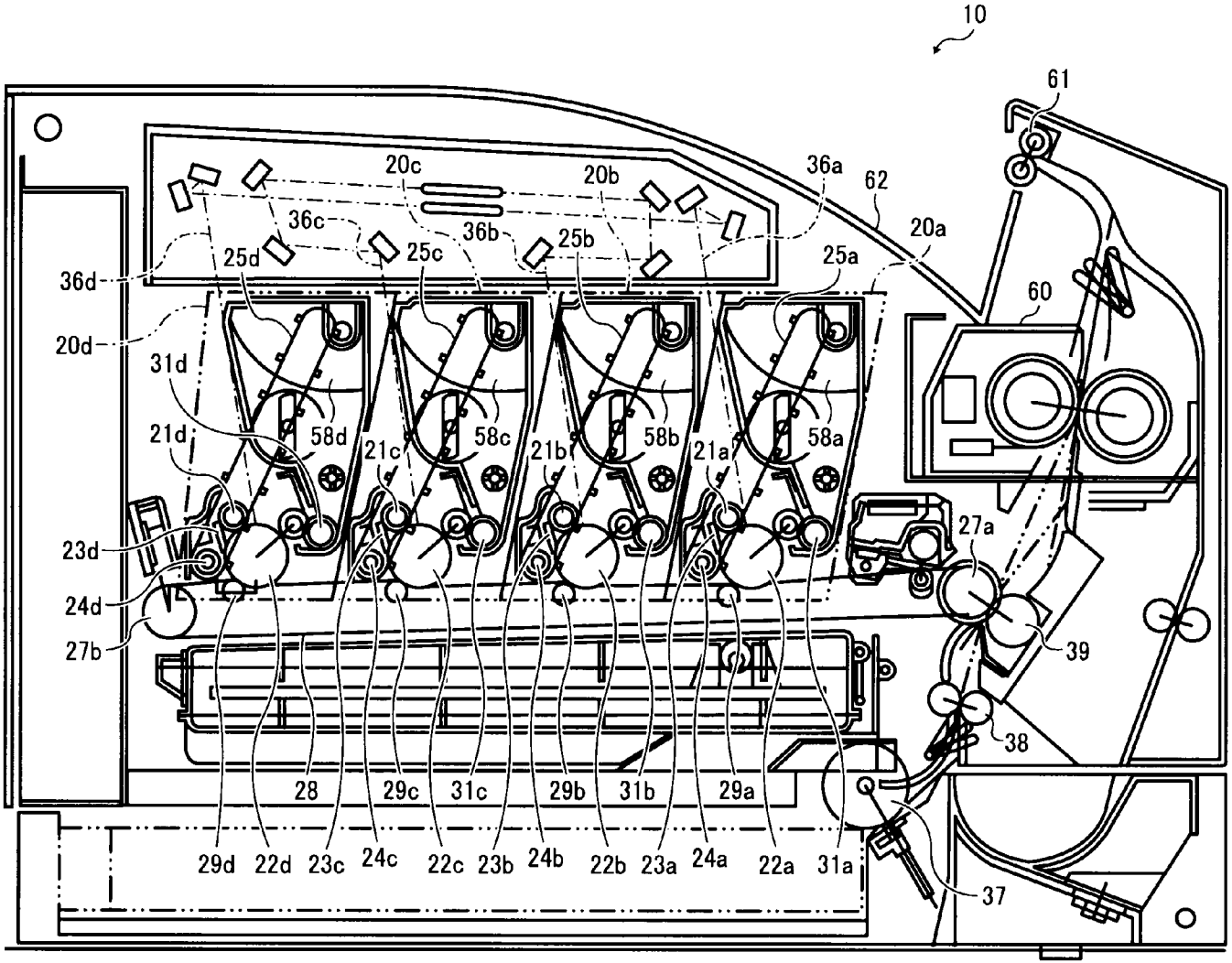
FIG. 1 is a side view of a color-image forming apparatus including four image forming units each of which including a photoconductor and a single developing device that is arranged on a periphery of the photoconductor in a state that the four image forming units is attached to the image forming apparatus.

FIG. 1 is a side view of a color-image forming apparatus 10 including four image forming units 20*a*, 20*b*, 20*c*, and 20*d* each of which including a photoconductor 22 and a developing device 31 that is arranged on a periphery of the photoconductor 22 in a state that the four image forming units is attached to the image forming apparatus.

Relevant parts of the color-image forming apparatus 10 are explained with reference to FIG. 1. The four developing devices 31 (31*a*, 31*b*, 31*c*, and 31*d*) accommodate toners of mutually different colors as developing agents. The photoconductors 22 (22*a*, 22*b*, 22*c*, and 22*d*) cooperate with a corresponding one of four developing devices 31. Cleaning blades 23 (23*a*, 23*b*, 23*c*, and 23*d*) that scrape out residual toners after a primary transfer, and charging rollers 21 (21*a*, 21*b*, 21*c*, and 21*d*) that are brought into contact with the photoconductors 22 are provided on the periphery of the photoconductors 22. Horizontal conveyer screws 24 (24*a*, 24*b*, 24*c*, and 24*d*) convey scraped toners in a horizontal direction. Toner conveyer belts 25 (25*a*, 25*b*, 25*c*, and 25*d*) receive the toner from the horizontal conveyer screw 24 and convey the toner upward. The conveyed toners are housed into deformable waste-toner housing units 58 (58*a*, 58*b*, 58*c*, and 58*d*). Image forming units 20 (20*a*, 20*b*, 20*c*, 20*d*) include these devices. The housing of each image forming unit 20 can include the developing device 31. An intermediate transfer unit includes an abutting driving roller 27*a*, a driven roller 27*b*, primary-transfer rollers 29 (29*a*, 29*b*, 29*c*, and 29*d*), and a rotatable intermediate transfer belt 28 that abuts with the primary-transfer rollers 29. The photoconductors 22 is exposed with laser beams 36 (36*a*, 36*b*, 36*c*, and 36*d*).

A core metal of each developing roller 32 of each of the developing device 31 is applied with a bias voltage of a negative potential overlapping an alternating current and a direct current from a bias power source (not shown). Each charging roller 21 is applied with a bias voltage with negative potential of a direct current by another bias power source. The photoconductor 22, the developing device 31, the cleaning blade 23, and the charging roller 21 form the image forming unit 20. The image forming apparatus 10 includes the four image forming units 20 of a first image forming unit 20*a*, a second image forming unit 20*b*, a third image forming unit 20*c*, and a fourth image forming unit 20*d*.

The cleaning blade 23*a* cleans the photoconductor 22*a* to remove residual waste toner on the peripheral surface of the photoconductor 22*a*. The charging roller 21*a* initializes the photoconductor 22*a*, by uniformly charging at a high potential on the peripheral surface of the photoconductor 22*a* after the cleaning process. The laser beam 36*a* is irradiated onto the photoconductor 22*a* of the first image forming unit 20*a*. The laser beam 36*b* is irradiated onto the photoconductor 22*b* of the second image forming unit 20*b*. Accordingly, the peripheral surface of the photoconductor 22*a* uniformly charged with the high potential is selectively exposed based on image data. As a result, a potential of a part that is subjected to the exposure becomes low and a potential of another part that is not subjected to the exposure remains high. Thus, by using difference in potential, an electrostatic latent image is formed on the peripheral surface of the photoconductor 22*a*. This operation is performed in a similar manner by the second image forming unit 20*b* to the fourth image forming unit 20*d*. The developing device 31*a* applies the toner onto the low-potential part (or the high-potential part) of the electrostatic latent image, to form (develop) a toner image.

The photoconductor 22*a* rotates and conveys the toner image, and transfers the image to the intermediate transfer belt 28. The second image forming unit 20*b* similarly operates in the timing that the toner image on the intermediate transfer belt 28 comes to a contact part of the photoconductor 22*b* at which the toner image is contacted to the photoconductor 22*b*. The developing device 31*b* forms a toner image by developing the electrostatic latent image on the photoconductor 22*b*. The photoconductor 22*b* conveys the toner image by rotation, and transfers the toner image in superimposition onto the toner image on the intermediate transfer belt 28. A similar operation is performed by the third image forming unit 20*c* and the fourth image forming unit 20*d*. A quadruple toner image is conveyed, and is transferred onto paper (not shown) by a secondary-transfer roller 39.

A paper feeding roller 37 and a conveyer roller 38 convey the transfer paper into the body of the image forming apparatus 10. The secondary-transfer roller 39 transfers the toner image formed on the intermediate transfer belt 28 onto the transfer paper.

The transfer paper transferred with the toner image is conveyed to a fixing unit 60. A fixing nip unit formed by the fixing roller of the fixing unit 60 and a pressing roller fixes the toner image. A discharging roller 61 positioned downstream in the transfer-paper conveyance direction of the fixing unit 60 discharges the transfer paper to a catch tray 62 located on the upper surface of the body of the image forming apparatus 10. The cleaning blade 23 that is in contact with the intermediate transfer belt 28 cleans the intermediate transfer belt 28 by removing residual toners on the intermediate transfer belt 28 in a similar manner that the cleaning blade 23 cleans the photoconductor 22. The waste toners are collected into the waste-toner housing unit 58 via a toner conveyer path 50.

The waste-toner housing unit 58 is detachable from the body of the image forming apparatus 10, and can be suitably replaced.

Each toner container, the intermediate transfer belt 28, and each imaging cartridge are positioned on the body of the image forming apparatus 10, with an inclination to the same direction, thereby decreasing the total length of the body of the image forming apparatus 10 to decrease the size of the image forming apparatus 10. Particularly, according to the present embodiment, among the image forming units 20, the image forming unit 20*a* that forms the black toner image is positioned at the transfer nip side, and the image forming unit 20*a* is inclined to be located at a lower position than the image forming unit 20*d*. Because the frequency of forming an image using only the black color is high among the colors, the image forming unit 20*a* is positioned at the transfer nip side, to decrease the printing time of the black image.

Figure 2:
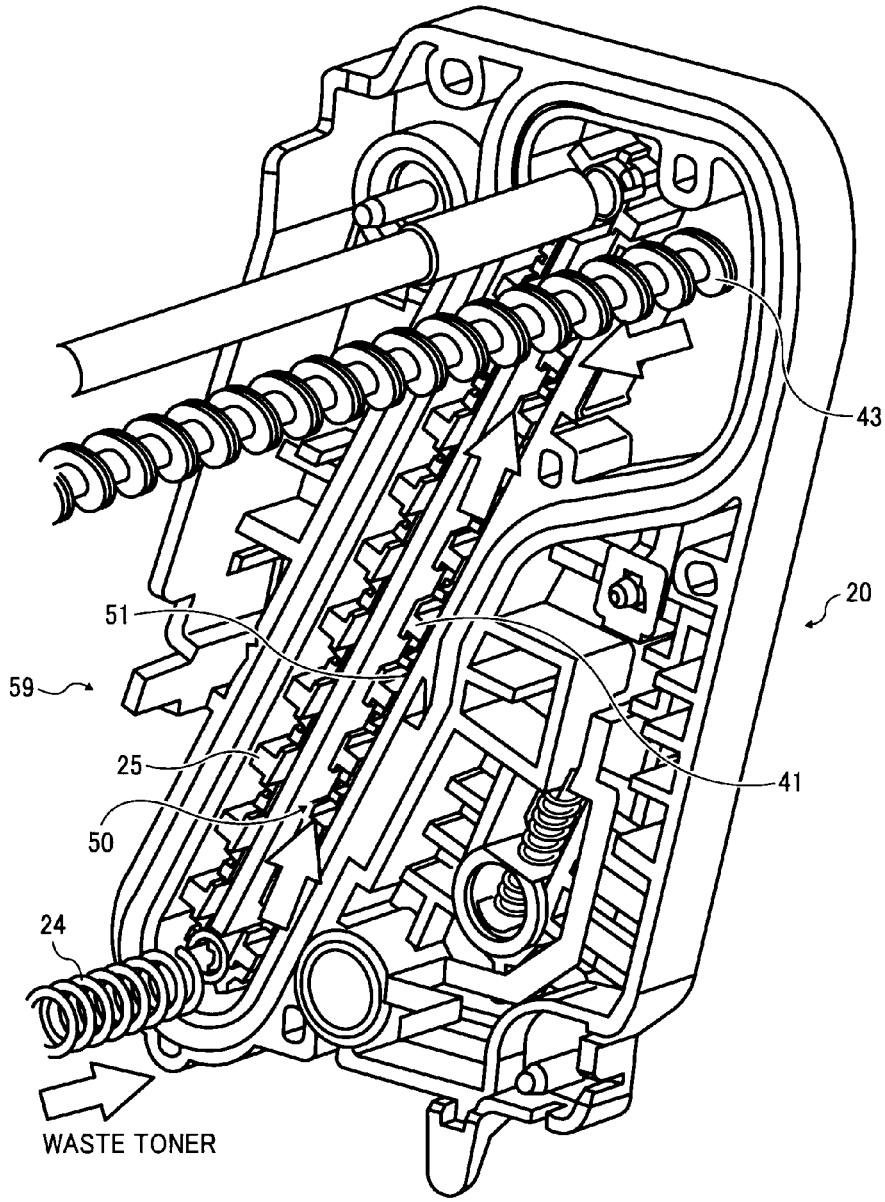
FIG. 2 is a perspective view of a toner conveyer device shown in FIG. 1 that conveys waste toner generated in the image forming unit.

FIG. 2 is a schematic diagram of the toner conveyer device 59 that collects the waste toner generated in the image forming unit. The horizontal conveyer screw 24 conveys the waste toners generated in the photoconductors 22 to the toner conveyer belt 25 that conveys the waste toner upwards. The toner conveyer belt 25 holds the waste toner in a gap between a convex part 41 of the rotating toner conveyer belt 25 and an inner wall 51 of the toner conveyer path 50, and are conveyed to a toner conveyer screw 43 located above. Thereafter, the waste toners are conveyed to a waste-toner housing unit 58 located ahead in the conveyance direction of the waste toners indicated by arrows. The toner conveyer device 59 efficiently collects the waste toners generated in the image forming unit 20, and efficiently fills the waste toners into a container by evenly accumulating the toners, thereby making the replacing cycle prolong. The toner conveyer device 59 conveys the waste toners generated in the image forming apparatus 10 into the waste-toner housing unit 58 that is detachable from the image forming apparatus 10. The toner conveyer device 59 is formed to match the surplus space shape within the body of the image forming apparatus 10. The toner conveyer device 59 includes the toner conveyer screw 43 that conveys accumulated waste toner to a portion within the waste-toner housing unit 58.

When the toner conveyer device 59 is mounted on the body of the image forming apparatus 10, a surface of the toner conveyer device 59 facing members provided on the body of the image forming apparatus 10 is formed in a shape corresponding to the opposing member. When the cleaning blades 23 are provided with an inclination within the body of the image forming apparatus 10, the opposing surface of the toner conveyer device 59 is parallel with the inclination surface inclined in the same direction as that of a line connecting between each cleaning blade 23 of each cleaning unit, and parallel with the line connecting between each cleaning blade 23 of each cleaning unit.

Figure 3:
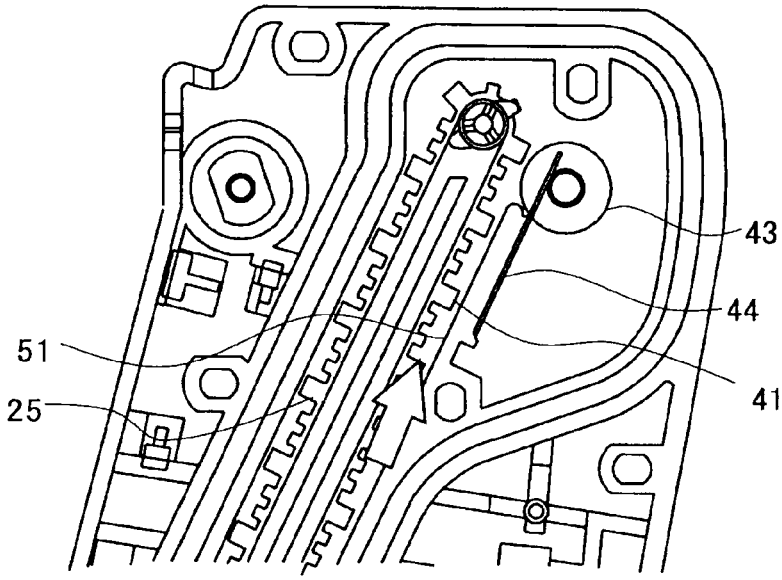
FIG. 3 is a front view of a portion of the toner conveyer device shown in FIG. 2.

A toner scraping mechanism according to an embodiment of the present invention is explained below. FIG. 3 is a front view of a relevant portion of the toner conveyer device 59 shown in FIG. 2. After conveyed by the toner conveyer belt 25 to the toner conveyer screw 43, the waste toner is conveyed to the waste-toner housing unit 58 by the toner conveyer screw 43. However, during the endurance or when the toners are started to be degraded, the toners delivered from the toner conveyer belt 25 can adheres to the toner conveyer screw 43, thereby decreasing efficiency in conveying the toner. Therefore, a scraping member 44 is positioned to go straight to the toner conveyer screw 43, between the toner conveyer belt 25 and the toner conveyer screw 43. With this arrangement, the toners adhering to the toner conveyer screw can be scraped out.

Figure 4:
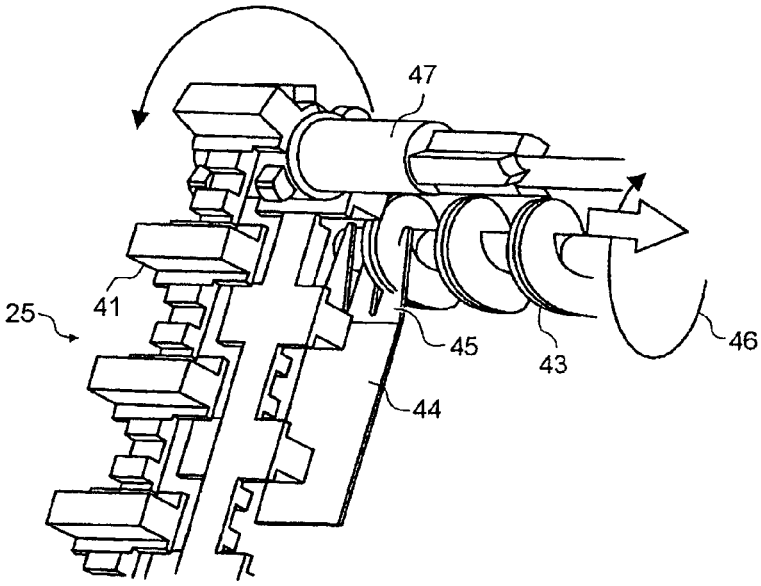
FIG. 4 is a perspective view of a portion of a toner conveyer screw that comes in contact with a scraping member shown in FIG. 3.

FIG. 4 is a perspective view of a portion of the toner conveyer screw 43 that comes in contact with the scraping member 44. As shown in FIG. 4, the scraping member 44 has at least one projection 45, and the projection 45 is brought into contact with the toner conveyer screw 43 to brush the toner conveyer screw 43 in its rotation direction 46. With this arrangement, the scraping member 44 keeps in contact with the toner conveyer screw 43 and scrapes toner adhered to it while receiving a force caused by the rotation of the toner conveyer screw 43. It is preferable to form a pitch of the scraping member 44 smaller than a pitch of the toner conveyer screw 43. The pitch of the scraping member 44 is an interval between points of the projections 45 that are closest to the toner conveyer screw 43, that is, an interval between apexes of triangle-shaped portions that come in contact with the toner conveyer screw 43 as shown in FIG. 4. Although a screw having a large diameter is used in a conventional toner conveyer device, a screw having a smaller diameter can be used in the toner conveyer device 59 because a conveyable toner amount does not decrease. This makes it possible to produce a smaller toner conveyer device.

Figure 5A:
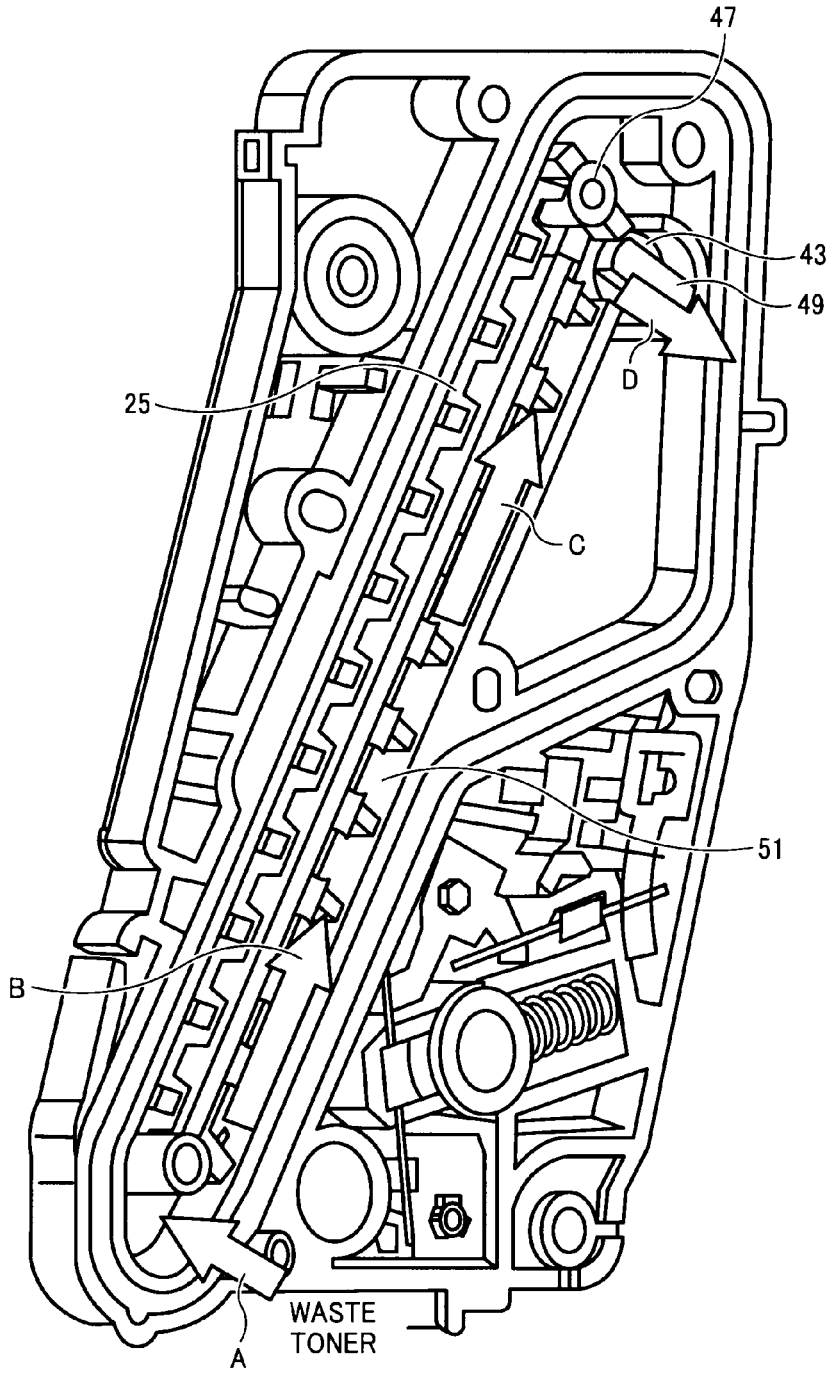
FIG. 5A is a detailed side view of the toner conveyer device shown in FIG. 2.
Figure 5B:
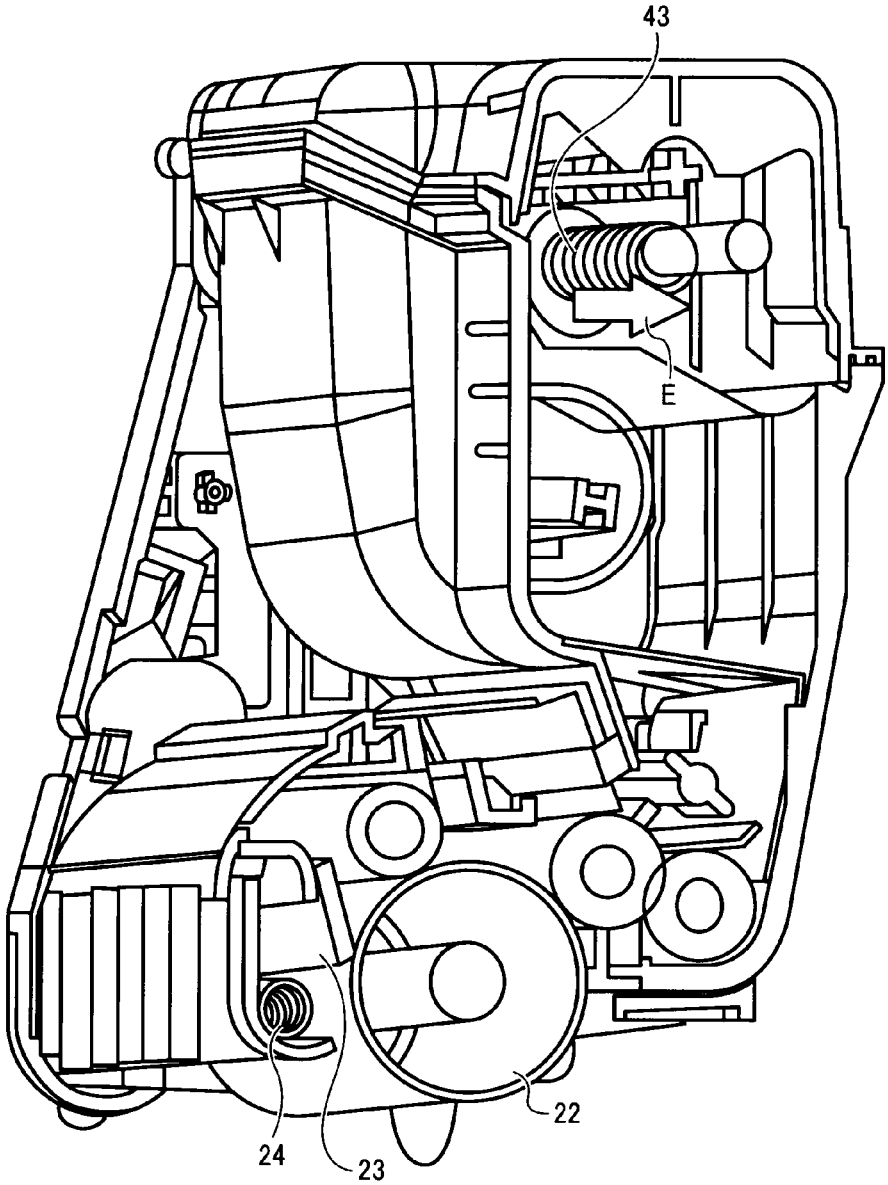
FIG. 5B is a perspective view of the toner conveyer device shown in FIG. 5A in a state interestedly formed with a process cartridge.

FIG. 5A is a detailed side view of the toner conveyer device, and FIG. 5B is a perspective view of the toner conveyer device in a state interestedly formed with a process cartridge.

A course along which the collected toner is conveyed is explained with reference to FIG. 5A.

Waste toner that fails to be transferred onto the transfer sheet is removed by the cleaning device, and is conveyed in a direction as shown in arrow A to the toner conveyer device 59 that is provided one side of the image forming apparatus 10 or the process cartridge.

After that, the waste toner is conveyed in a direction as shown in arrows B and C to the toner conveyer screw 43 while being held in a gap between the convex part 41 of the toner conveyer belt 25 and the inner wall 51 of the toner conveyer path 50.

The waste toner is then conveyed in a direction as shown in arrow D in FIG. 5A and arrow E in FIG. 5B to the waste-toner housing unit 58 by the toner conveyer screw 43.

Salient features of the embodiment are explained below with reference to FIG. 5A. The toner conveyer screw 43 has a free-end portion 43*a*. Vibration of the toner conveyer screw 43 caused by rotation has an effect of preventing the waste toners from being adhered to threads thereof. A supporting member 49 that is shaped letter U supports the free-end portion 43*a*. The supporting member 49 is opened toward the center of a conveyer-belt driving shaft 47. With this arrangement, the waste toners are efficiently conveyed from the toner conveyer belt 25 to the toner conveyer screw 43.

Figure 6:
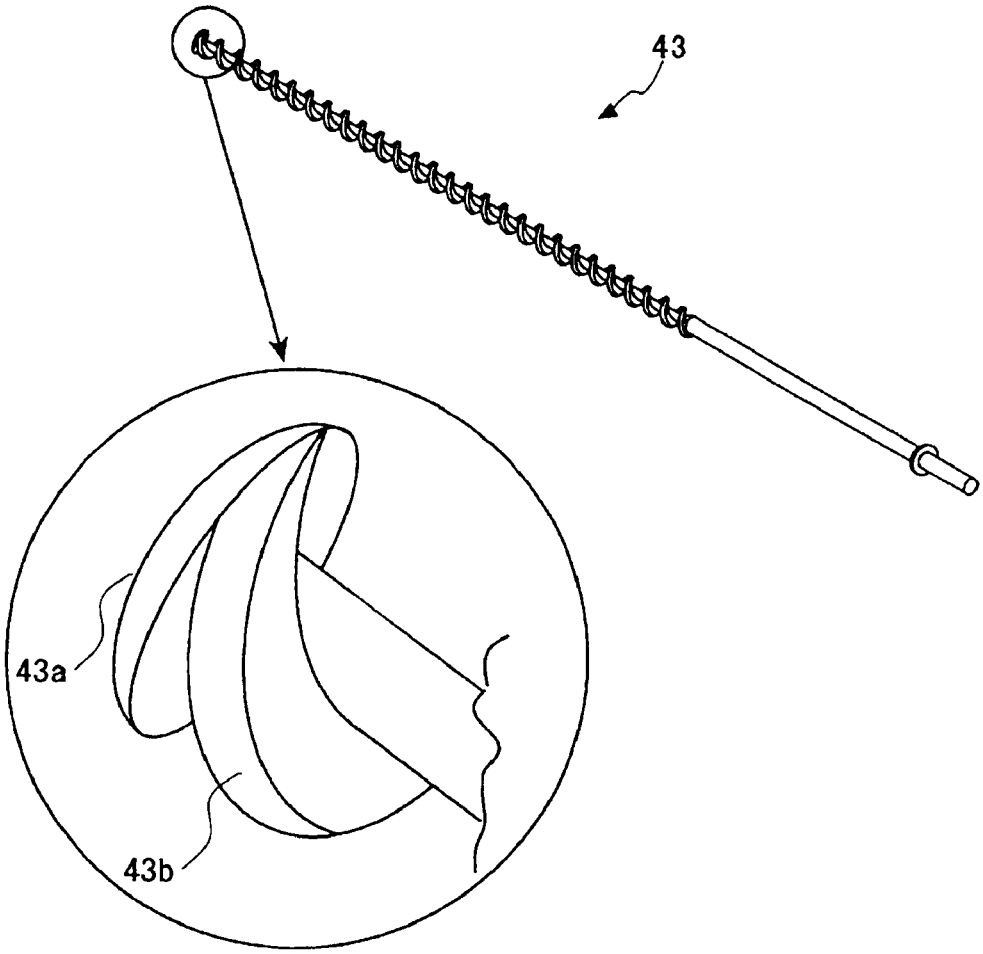
FIG. 6 is a perspective view of a toner conveyer screw shown in FIG. 2 and an enlarged view of a free-end portion thereof.

FIG. 6 is a perspective view of the toner conveyer screw 43 and an enlarged view of the free-end portion 43*a* thereof. The free-end portion is a circular, rounded surface. An external diameter of the free-end portion 43*a* is equal to an external diameter of a thread 43*b* of the toner conveyer screw 43. The similar effect can be obtained when the external diameter of the free-end portion 43*a* is larger than the external diameter of the thread 43*b*. Only the free-end portion 43*a* comes in contact with the supporting member 49, that is, the thread 43*b* does not come in contact with an inner surface of the supporting member 49, which makes it possible to prevent increase in the rotation torque and noise generated by sliding. Moreover, because an internal diameter of the supporting member 49 is larger than the external diameter of the free-end portion 43*a* of the U-shaped supporting member 49, the supporting member 49 does not suppress vibration of the free-end portion 43*a*. Thus, this brings an effect of removing the waste toner adhering to the thread 43*b*, thereby preventing the toner conveyer screw 43 from toner clogging which decrease a convey amount.

The driving source of the toner conveyer device 59 is explained below. The toner conveyer device 59 is driven by using the developing device 31 and the photoconductor 22. With this arrangement, units of the toner conveyer device 59 can be easily integrated with each other, and an additional driving source is unnecessary.

Figure 7:
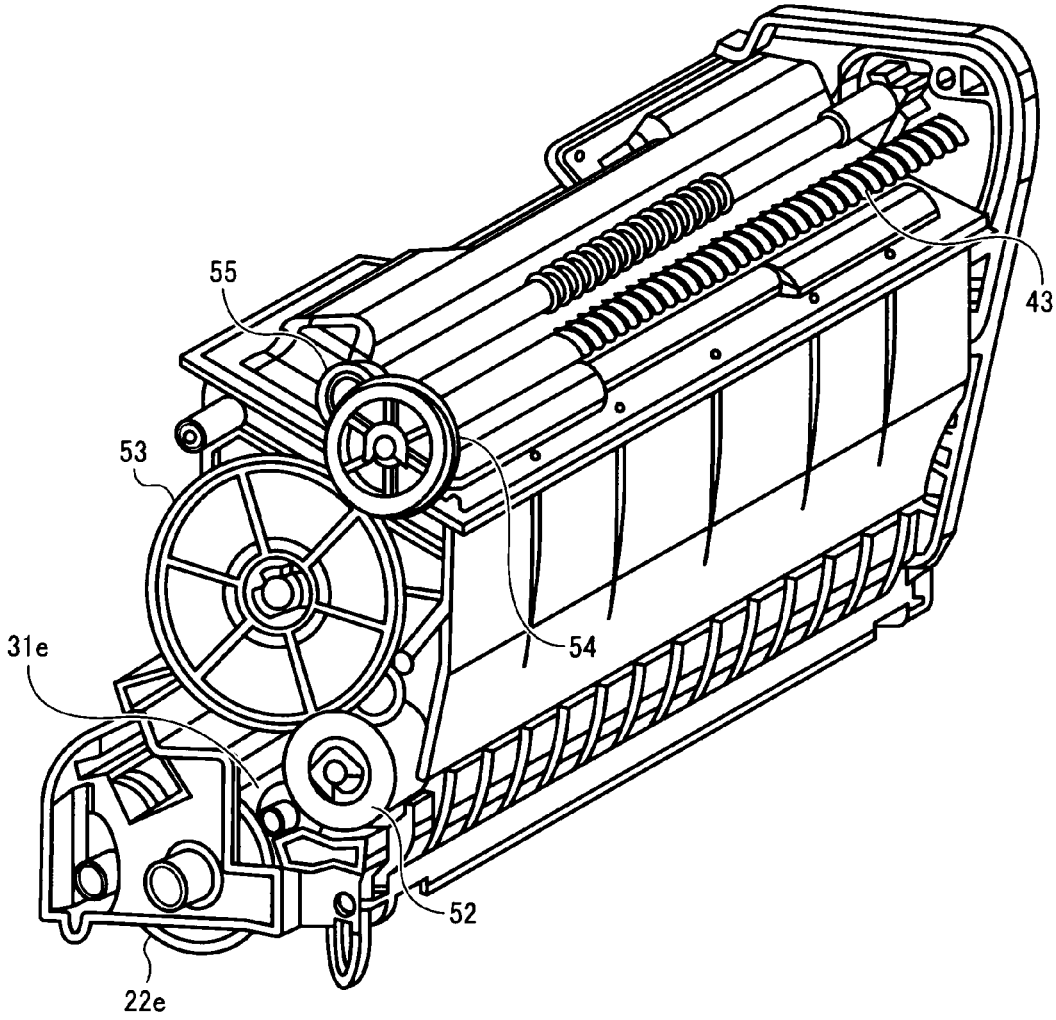
FIG. 7 is a perspective view of a process cartridge including a developing device and a photoconductor, and the toner conveyer device shown in FIG. 2 integrated together.

A driving mechanism in a state that the toner conveyer device 59 is integrated with a process cartridge including the developing device 31 and the photoconductor 22 is explained below. FIG. 7 is a perspective view of the process cartridge including the developing device 31, the photoconductor 22, and the toner conveyer device 59. As shown in FIG. 7, a photoconductor gear 22*e* is provided at a flange at one end of the photoconductor 22. The photoconductor gear 22*e* receives driving force from a driving source (not shown) in the image forming apparatus. The driving force is transmitted from the photoconductor gear 22*e* to a developing-roller gear 31*e*, a toner stirring gear 52, and an agitator gear 53. The driving force is further transmitted to a toner conveyer-screw gear 54, and a conveyer-belt driving-shaft gear 55.

This driving force is used to rotate the toner conveyer belt 25 via the conveyer-belt driving shaft 47. An end of the toner conveyer screw 43 opposite to an end having the toner conveyer-screw gear 54 is a free end, so that all the above driving units can be arranged at one side. As a result, it is possible to produce a small process cartridge in which the toner conveyer device 59 is arranged a side opposite to the side where the driving units are arranged.

As explained above, the process cartridge includes the toner conveyer device, thereby decreasing the size of the process cartridge, without generating clogging of toners. Therefore, always a satisfactory printer image (copy image) can be provided. Because the process cartridge is detachable from the image forming apparatus, maintenance and replacement operation of the process cartridge can be easier.

Figure 8A:
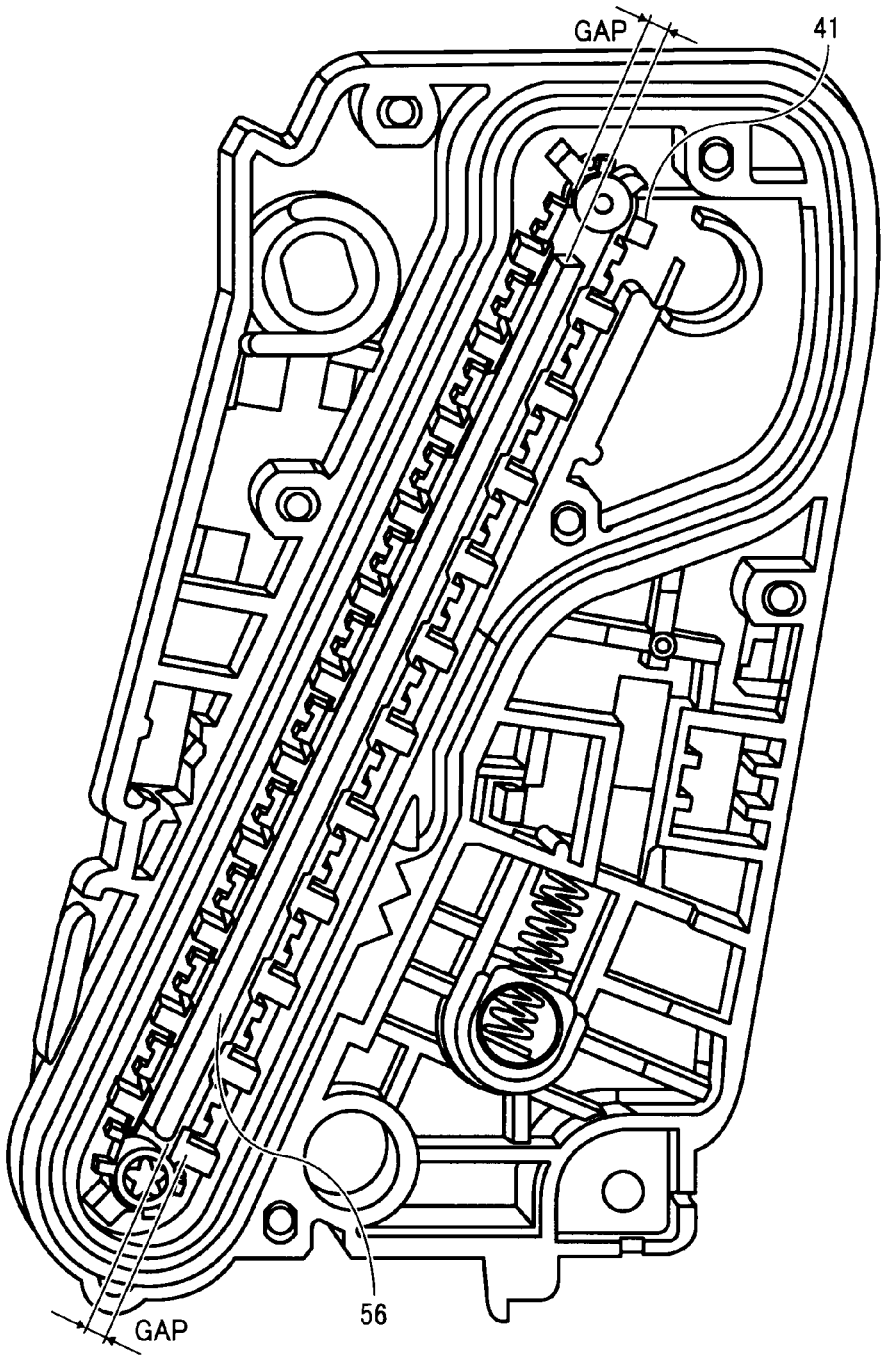
FIGS. 8A and 8B are perspective views of a toner conveyer device that can prevent clogging of toners with a toner conveyer belt.
Figure 8B:
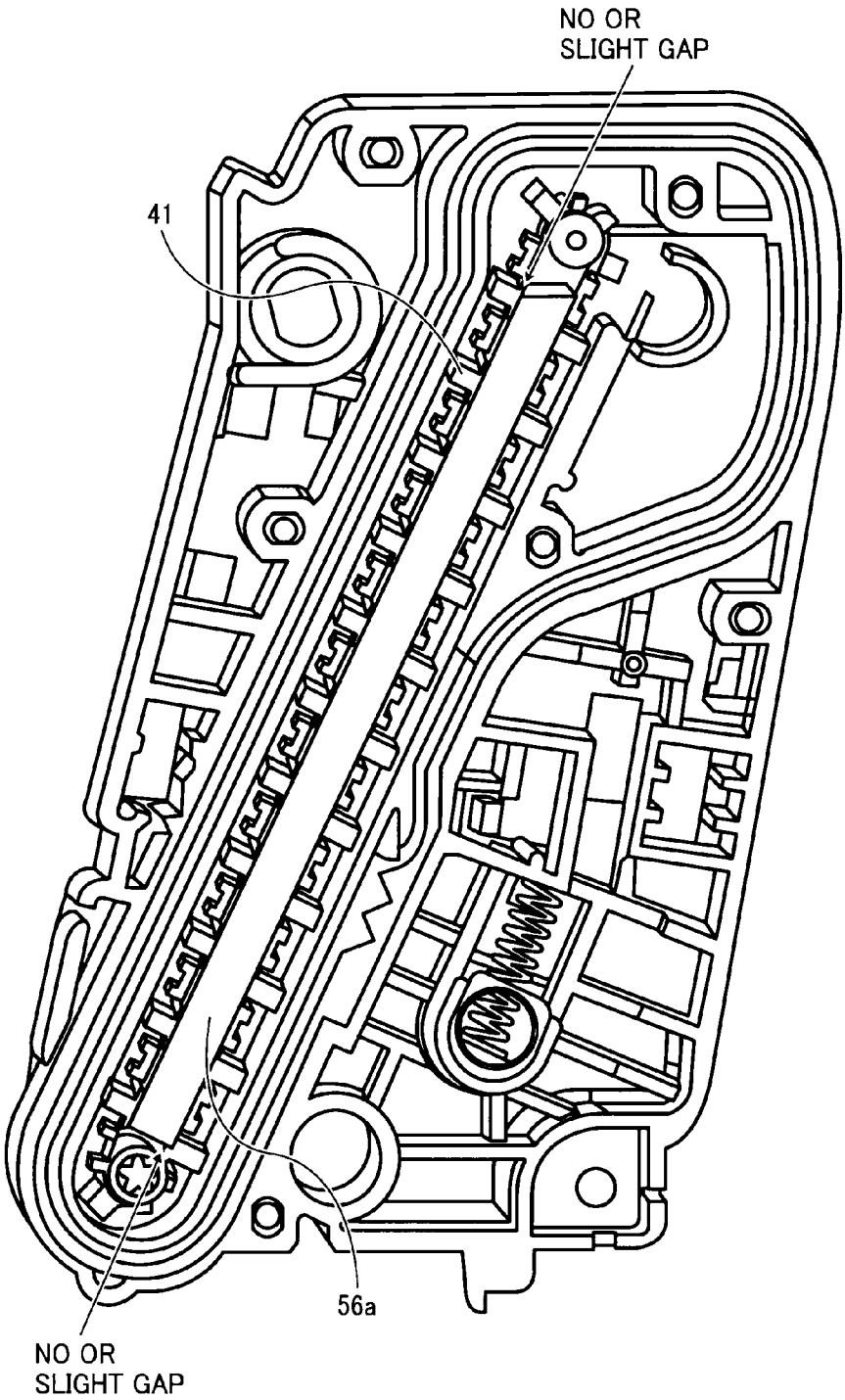

FIGS. 8A and 8B are perspective view of a toner conveyer device that can prevent clogging of toners with the toner conveyer belt. As shown in FIG. 8A, a wall 56 is provided within the space encircled by the toner conveyer belt 25. With this arrangement, space in which toners are clogged becomes small other than the toner conveyer path (the space between the convex part 41 of the toner conveyer belt 25 and the inner wall 51 indicated by the arrowheads B and C in FIG. 5A). In other words, the volume of toners that are clogged within the space encircled by the toner conveyer belt 25 becomes small. Therefore, even when the toner conveyer device is detached from the image forming apparatus or even when the toner conveyer device is left for a long time, this arrangement prevents toners pooled at the upper part of the toner conveyer device from falling down, therefore it is possible to prevent concentration or agglomeration of toners at the lower part. Consequently, the toners can be conveyed smoothly.

Furthermore, the space in which toners are pooled is substantially eliminated other than the toner conveyer path, by increasing the width of the wall 56 provided within the space encircled by the toner conveyer belt 25, and by providing a wall 56*a* to be in contact with the toner conveyer belt 25, as shown in FIG. 8B. Even when the toner conveyer device 59 is detached from the image forming apparatus or even when the toner conveyer device is left for a long time, this arrangement prevents toners pooled at the upper part of the toner conveyer device from falling down, therefore it is possible to prevent concentration or agglomeration of toners at the lower part. Consequently, the toners can be conveyed smoothly. When the above methods are used, clogging of toners at the lower part of the toner conveyer belt 25 can be prevented. The method of decreasing space in which toners are clogged other than the toner conveyer path can be applied very effectively to the toner conveyer device that conveys the toner upward with at least an inclination. Because the process cartridge includes such a toner conveyer device and because the process cartridge is detachable from the image forming apparatus, maintenance and replacement operation of the process cartridge becomes easier. Because the image forming apparatus 10 has the process cartridge mounted thereon, always a satisfactory printer image (copy image) can be obtained.

As shown in FIG. 1, a process cartridge according to the embodiment uses the image forming unit 20 as it is, and includes the photoconductor 22, the cleaning device, and the toner conveyer device 59. Further, at least one device selected from the charging roller 21 and the developing roller 32 is integrally detachably supported. With this arrangement, the developing agent and the developing device 31 can be replaced easily thereby a life time of the image forming apparatus 10 is prolonged.

According to an embodiment of the present invention, the toner scraping member removes toners adhered to a surface of the screw, thereby an amount of toner that is conveyed by the screw does not decrease.

Moreover, a single toner conveyer device conveys new toners and the waste toners. Therefore, it is possible to use the process cartridge for a long time, and an operation for replacing the process cartridge becomes easier.

Furthermore, because an amount of toner that is conveyed by the screw does not decrease, the stable cleaning performance can be maintained for a long time.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A toner conveyer device for use in an image forming apparatus, the toner conveyer device comprising:
a toner conveyer belt that conveys waste toner;
a screw member that receives the waste toner from the toner conveyer belt and conveys the waste toner to a housing unit; and
a scraping member that scrapes waste toner that adheres to the screw member,
wherein the scraping member is arranged between the toner conveyer belt and the screw member, and
wherein the screw member has a free-end portion, the free-end portion being a circular rounded surface, an external diameter of the free-end portion being equal to or larger than an external diameter of a thread of the screw member.

2. The toner conveyer device according to claim 1, wherein the scraping member contacts the screw member.

3. The toner conveyer device according to claim 2, wherein the scraping member has a shape that matches with a shape of a thread of the screw member.

4. The toner conveyer device according to claim 1, wherein the scraping member includes at least one projection which the screw member contacts.

5. The toner conveyer device according to claim 4, wherein a pitch of the screw member is smaller than a pitch of the projection of the scraping member.

6. The toner conveyer device according to claim 1, wherein the housing unit is deformable.

7. The toner conveyer device according to claim 1, wherein the toner conveyer belt is supported on a surface forming an angle within a range from 0 to 90 degrees with respect to horizontal plane.

8. The toner conveyer device according to claim 1, further comprising a supporting member that supports the free-end portion, the supporting member having a U-shaped opening toward a center of a driving shaft, the driving shaft located on a most elevated level in the toner conveyer belt for rotatably supporting the toner conveyer belt.

9. The toner conveyer device according to claim 8, wherein an internal diameter of the supporting member is larger than the external diameter of the free-end portion.

10. The toner conveyer device according to claim 1, further comprising:
a driving shaft that rotates the toner conveyer belt; and
a driving source that transmits a driving force to the toner conveyer device via the driving shaft, wherein the driving source is located on a first side that is opposite, across the driving shaft, to a second side where the toner conveyer belt is located.

11. The toner conveyer device according to claim 10, wherein the driving source is a photoconductor gear.

12. The toner conveyer device according to claim 1, further comprising a wall that is arranged inside a space defined by an internal surface of the toner conveyer belt and is adjacent to the internal surface.

13. The toner conveyer device according to claim 12, wherein the wall forms no clearance or a slight clearance between the wall and the internal surface.

14. The toner conveyer device according to claim 12, wherein the toner conveyer belt is supported on a surface forming an angle within a range from 0 to 90 degrees with respect to horizontal plane to convey the waste toner upward.

15. A process cartridge detachable from an image forming apparatus, the process cartridge comprising:
a photoconductor that carries a latent image;
a cleaning device that removes waste toner remaining on the photoconductor; and
a toner conveyer device that includes:
a toner conveyer belt that conveys waste toner;
a screw member that receives the waste toner from the toner conveyer belt and conveys the waste toner to a housing unit; and
a scraping member that scrapes waste toner that adheres to the screw member,
wherein the scraping member is arranged between the toner conveyer belt and the screw member, and
wherein the screw member has a free-end portion, the free-end portion being a circular rounded surface, an external diameter of the free-end portion being equal to or larger than an external diameter of a thread of the screw member.

16. An image forming apparatus comprising:
a photoconductor that carries an electrostatic latent image;
a developing device that receives toner from a developing-agent carrier and develops the latent image with the toner to form a toner image;
a transfer device that transfers the toner image onto a recording medium;
a cleaning device that removes residual waste toner from the photoconductor; and
a toner conveyer device that includes:
a toner conveyer belt that conveys the waste toner;
a screw member that receives the waste toner from the toner conveyer belt and conveys the waste toner to a housing unit; and
a scraping member that scrapes waste toner that adheres to the screw member,
wherein the scraping member is arranged between the toner conveyer belt and the screw member, and
wherein the screw member has a free-end portion, the free-end portion being a circular rounded surface, an external diameter of the free-end portion being equal to or larger than an external diameter of a thread of the screw member.

* * * * *